United States Patent [19]

Vanderlaan

[11] Patent Number: 4,534,273

[45] Date of Patent: Aug. 13, 1985

[54] CONTROL ACTUATION SYSTEM INCLUDING STAGED DIRECT DRIVE VALVE WITH FAULT CONTROL

[75] Inventor: Robert D. Vanderlaan, Kalamazoo, Mich.

[73] Assignee: Pneumo Corporation, Boston, Mass.

[21] Appl. No.: 680,231

[22] Filed: Dec. 10, 1984

Related U.S. Application Data

[63] Continuation of Ser. No. 463,631, Feb. 3, 1983, abandoned.

[51] Int. Cl.[3] ..... F15B 11/00

[52] U.S. Cl. ..... 91/510; 91/522; 137/596.15; 137/596.16; 251/129.03; 251/129.13

[58] Field of Search ..... 91/363 A, 365, 417 R, 91/461, 509, 510, 522; 137/596, 596.15, 596.16, 596.17, 625.48, 625.63, 625.64; 251/61.2, 133

[56] References Cited

U.S. PATENT DOCUMENTS

| | | | |
|---|---|---|---|
| 3,190,185 | 6/1965 | Rasmussen | 91/509 |
| 3,529,514 | 9/1970 | Mayo et al. | 91/509 |
| 3,543,642 | 12/1970 | Seamone | 91/510 |
| 3,640,185 | 2/1972 | Korsak | 91/522 |
| 3,805,670 | 4/1974 | Fallows, Jr. | 91/417 R |
| 3,847,060 | 11/1974 | Jasinski et al. | 91/461 |
| 3,874,405 | 4/1975 | Thayer | 137/625.64 |
| 4,009,642 | 3/1977 | Vanderlaan | 91/363 A |
| 4,201,116 | 5/1980 | Martin | 91/365 |

*Primary Examiner*—Abraham Hershkovitz
*Attorney, Agent, or Firm*—Maky, Renner, Otto & Boisselle

[57] ABSTRACT

A control actuation system for an aircraft including an electromechanically controlled, hydraulically powered actuator for driving a main control valve of a dual hydraulic servo-actuator control system. The actuator includes a tandem piston connected to the main control valve which is controllably positioned by a staged valve of relatively short stroke whereby a force motor of minimum size and energy requirements may be used to directly drive the valve. The staged valve includes a linearly movable valve plunger for simultaneously controlling the differential application of fluid pressure from respective hydraulic systems on opposed pressure surfaces of respective piston sections to cause movement of the piston in response to relatively short axial movement of the valve plunger as long as at least one hydraulic system remains operative. Also, the staged valve includes a fault control valve sleeve concentric with the valve plunger which, upon shut-down or failure of both hydraulic systems, moves linearly to render the valve plunger inoperative and release fluid pressure from opposed, corresponding pressure surfaces of the tandem piston to respective returns therefor through respective centering rate control orifices in the fault control valve sleeve as the piston is moved to a neutral position by a centering spring device acting on the main control valve.

28 Claims, 3 Drawing Figures

CONTROL ACTUATION SYSTEM INCLUDING STAGED DIRECT DRIVE VALVE WITH FAULT CONTROL

This application is a continuation, of application Ser. No. 463,631, filed Feb. 3, 1983, now abandoned.

This invention relates generally to a fluid servo system, and more particularly to an aircraft flight control servo system including a control actuation system incorporating an electro-mechanically controlled, hydraulically powered actuator for use in driving a main control valve of the servo system.

BACKGROUND OF THE INVENTION

Fluid servo systems are used for many purposes, one being to position the flight control surfaces of an aircraft. In such an application, system redundancy is desired to achieve increased reliability in various modes of operation, such as in a control augmentation or electrical mode.

In conventional electro-hydraulic systems, plural redundant electro-hydraulic valves have been used in conjunction with plural redundant servo valve actuators to assure proper position control of the system's main control servo valve in the event of failure of one of the valves and/or servo actuators, or one of the corresponding hydraulic systems. Typically, the servo actuators operate on opposite ends of a linearly movable valve element of the main control valve and are controlled by the electro-hydraulic valves located elsewhere in the system housing. Although the servo valve actuators, alone or together, advantageously are capable of driving the linear movable valve element against high reaction forces, such added redundancy results in a complex system with many additional electrical and hydraulic elements necessary to perform the various sensing, equalization, timing and other control functions. This gives rise to reduced overall reliability, increased package size and cost, and imposes added requirements on the associated electronics.

An alternative approach to the electro-hydraulic control system is an electro-mechanical control system wherein a force motor is coupled directly and mechanically to the main control servo valve. In this system, redundancy has been accomplished by mechanical summation of forces directly within the multiple coil force motor as opposed to the conventional electro-hydraulic system where redundancy is achieved by hydraulic force summing using multiple electro-hydraulic valves and actuators. If one coil or its associated electronics should fail, its counterpart channel will maintain control while the failed channel is uncoupled and made passive. Such alternative approach, however, has a practical limitation in that direct drive forces motors utilizing state of the art rare earth magnet materials are not capable of producing desired high output forces at the main control servo valve within acceptable size and weight limitations.

In aircraft flight control systems, it also is advantageous and desirable to provide for controlled recentering of the main control servo valve in the event of a total failure or shut-down of the electrical operational mode. This is particularly desirable in those control systems wherein a manual input to the main servo valve is provided in the event that a mechanical reversion is necessary after multiple failures have rendered the electrical mode inoperative. In known servo systems of this type, the manual input may operate upon the spool of the main servo valve whereas the electrical input operates upon the movable sleeve of the main servo valve.

Upon rendering the electrical mode inactive, it is necessary to move the valve sleeve to a neutral or centered position and lock it against movement relative to the valve spool controlled by the manual input. Heretofore, this has been done by using a centering spring device which moves the valve sleeve to its centered or neutral position and a spring biased plunger that engages a slot in the valve sleeve to lock the latter against movement. The plunger normally is maintained out of engagement with the slot during operation in the electrical mode by hydraulic system pressure, and may have a tapered nose that engages a similarly tapered slot in the valve sleeve to assisat in centering the valve sleeve.

APPLICANT'S APPLICATION SER. NO. 442,873

In applicant's pending application Ser. No. 442,873, filed Nov. 19, 1982, entitled "Redundant Control Actuation System—Concentric Direct Drive Valve", now U.S. Pat. No. 4,473,988, granted Sept. 25, 1984, there is disclosed a redundant control actuation system which finds particular utility in an aircraft servo actuator control system, the actuation system including an electro-mechanically controlled, hydraulically powered actuator for driving a main control valve element of the control system. Briefly, the actuator includes a tandem piston connected to the main control valve element and a force motor driven, tandem pilot valve axially movable in the piston for simultaneously controlling the differential application of fluid pressure from respective hydraulic systems on opposed pressure surfaces of respective piston sections to cause movement of the piston in response to relative axial movement of the pilot valve as long as at least one hydraulic system remains operative. The piston is movable to a null positional relationship with the pilot valve providing balanced application of pressure forces on the opposed pressure surfaces of the piston sections whereby unitary positional feedback is effected between the piston and pilot valve.

The pilot valve may be directly driven by a linear or rotary force motor drive which may be of relatively small size and power requirements and yet the system is capable of driving the main control valve element against high reaction forces as the valve element is hydraulically powered by one or both of the hydraulic systems. In addition, the piston pressure surfaces are sized and compactly arranged to minimize force unbalance on the piston due to pressure variations in the hydraulic systems.

Also provided is a shut-off valve sleeve concentric with the pilot valve and piston which renders the pilot valve inoperative upon failure or shut-down of both hydraulic systems and releases fluid pressure from opposed, corresponding pressure surfaces of the piston sections to respective returns therefor through respective centering rate control orifices as the piston is moved to a neutral position by a centering spring device acting on the main control valve. For normal operaion, the shut-off valve sleeve is movable by fluid pressure from either hydraulic system to a position permitting controlled differential application of fluid pressure to the piston sections by the pilot valve. In addition, system pressure is applied to the actuator mechanism through shut-down valves which, upon shut-down of the system, disconnect the actuator from system pressure sources and release fluid pressure from other opposed, corresponding pressure surfaces of the piston sections to return through flow restricting orifices, whereby the piston is hydraulically locked against high loads of short duration.

The foregoing system particularly is suited for use in applications where the required stroke of the main control valve element is relatively small and about equal the desired stroke for the pilot valve. In some applications, however, the required stroke of the main control valve element is relatively long and may be several times longer than can be the stroke of the pilot valve within acceptable size and weight limitations. This would be the case, for example, for flight controls requiring main control valve flow rates of 15 to 25 gallons per minute and a stroke of about plus or minus 0.050 inch or more, whereas the pilot valve desirably would have a flow rate of less than one gallon per minute and a stroke of say plus or minus 0.015 inch.

Also in long stroke applications, the force motor then would be required to have high output energy capability. The energy required of a force motor to drive the pilot valve is approximately proportional to force required times stroke over which the force must act, the force level usually being established by specified valve chip shearing requirements in aircraft applications. With applicant's foregoing system, the relatively long stroke requirement placed upon the pilot valve therein imposes an energy penalty on the force motor. Accordingly, there would be required a higher energy force motor which is disadvantageous because it is larger and heavier and requires higher electrical power, associated larger electrical circuit elements and heat rejection devices.

SUMMARY OF THE INVENTION

The control actuation system of the present invention provides many of the advantages afforded by applicant's above described system and still other advantages in applications requiring, in particular, a relatively long stroke main control valve. Briefly, the actuation system includes an electro-mechanically controlled, hydraulically powered actuator for driving the main control valve of a servo actuator control system. The actuator includes a tandem piston connected to the main control valve which is controllably positioned by a staged valve having a relatively short stroke whereby a force motor of minimum size and energy requirements may be used to directly drive the valve. Despite the relatively small size and output energy capability of the force motor, the system is capable of driving the main control valve through a relatively long stroke and against high reaction forces as the valve is hydraulically powered by one or both of the hydraulic systems.

In particular, the staged direct drive valve includes a linearly movable, tubular valve plunger connected at one end to a flexible quill which extends through and out of the tubular valve plunger for connection to either a rotary or linear force motor. With a rotary force motor, the flexible quill has a ball bearing in which is engaged an eccentric pin on the force motor drive shaft, and flexing of the quill accommodates the rise and fall of the bearing during short arcuate movement of the eccentric pin without applying significant side loads to the valve plunger. Alternatively, a linear force motor may have its linear drive member connected to the flexible quill whereby flexing of the quill accommodates any misalignment of the drive member and valve plunger without applying significant side loads to the valve plunger.

Also, the staged valve includes a fault control valve sleeve concentric with the valve plunger which, upon shut-down or failure of both hydraulic systems, moves linearly to render the valve plunger inoperative and release fluid pressure from opposed, corresponding pressure surfaces of the tandem piston to respective returns therefor through respective centering rate control orifices in the fault control valve sleeve as the piston is moved to a neutral position by a centering spring device acting on the main control valve. For normal operation, the fault control valve sleeve is movable by fluid pressure from either hydraulic system to a position permitting controlled differential application of fluid pressure to the tandem piston sections by the valve plunger. In addition, system pressure is applied to the actuator through shut-down valves which, upon shut-down of the system, disconnect the actuator from system pressure sources and release fluid pressure from other opposed, corresponding pressure surfaces of the tandem piston sections to return through flow restricting orifices, whereby the piston is hydraulically locked against high loads of short duration.

In view of the foregoing, it accordingly is a principal object of the invention to provide a control actuation system for driving the main control valve of a dual hydraulic servo actuator control system which obtains the advantages of both electro-hydraulic and electro-mechanical control systems while eliminating drawbacks associated therewith.

Another object of the invention is to provide such a control actuation system which is capable of being electro-mechanically controlled by a linear or rotary force motor drive within acceptable size and weight limitations.

Another principal object of the invention is to provide such a control actuation system that is particularly suited for use in applications requiring driving of the main control valve through a relatively long stroke in relation to the stroke of the force motor drive.

Still another object of the invention is to provide such a control actuation system that has high reliability, reduced complexity, and reduced package size and cost in relation to known comparable systems.

Yet another object of the invention is to provide such a control actuation system that is capable of driving the main control valve against relatively high reaction forces.

A further object of the invention is to provide such a control actuation system which effects re-centering of the main control servo valve at a controlled rate under system shut-down or failure conditions.

A still further object of the invention is to provide such a control actuation system with a fault control having centering rate control provisions that is responsive to one or both hydraulic systems and effective regardless of control actuator stroke position.

Another object of the invention is to provide such a control actuation system which has high stiffness and is capable of supporting high loads.

These and other objects of the invention will become more apparent from the following description when read in light of the annexed drawings.

To the accomplishment of the foregoing and related ends, the invention, then, comprises the features hereinafter fully described and particularly pointed out in the claims, the following description and the annexed drawings setting forth in detail a certain illustrative embodiment of the invention, this being indicative, however, of but one of the various ways in which the principles of the invention may be employed.

DETAILED DESCRIPTION

Figure 1:
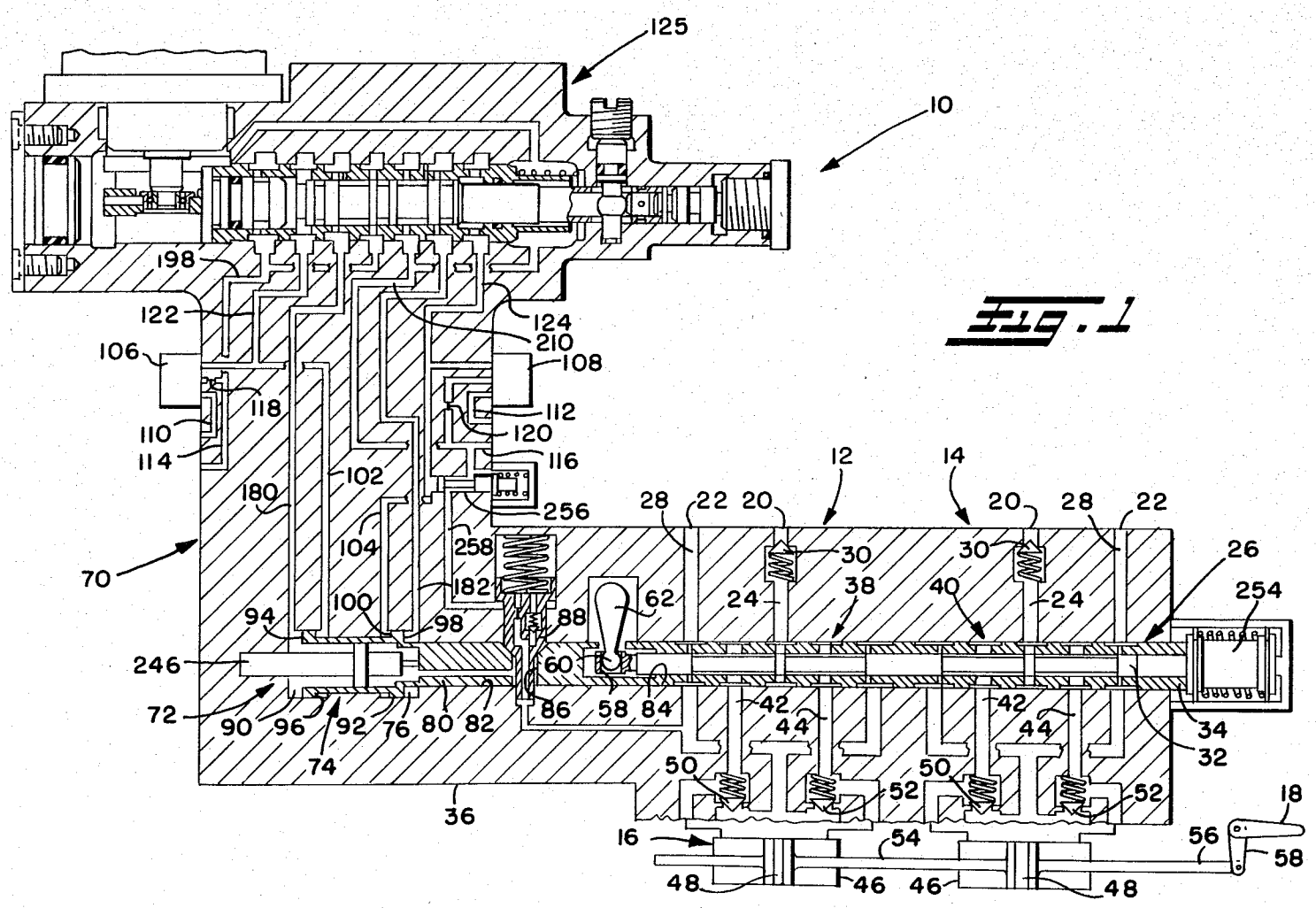
FIG. 1 is a schematic illustration of a redundant servo system embodying a preferred form of a control actuation system including staged direct drive valve with fault control, according to the invention.

Referring now in detail to the drawings and initially to FIG. 1, a dual hydraulic servo system is designated generally by reference numeral 10 and includes two similar hydraulic servo actuators 12 and 14 which are connected to a common output device such as a dual tandem cylinder actuator 16. The actuator 16 in turn is connected to a control member such as a flight control element 18 of an aircraft. It will be seen below that the two servo actuators normally are operated simultaneously to effect position control of the actuator 16 and hence the flight control element 18. However, each servo actuator preferably is capable of properly effecting such position control independently of the other so that control is maintained even when one of the servo actuators fails or is shut down. Accordingly, the two servo actuators in the overall system provide a redundancy feature that increases safe operation of the aircraft.

The servo actuators seen in FIG. 1 are similar and for ease in description, like reference numerals will be used to identify corresponding like elements of the two servo actuators. For a more detailed illustration of the servo actuators, reference may be had to applicant's above noted U.S. Pat. No. 4,473,988.

The servo actuators 12 and 14 each have an inlet port 20 for connection with a source of high pressure hydraulic fluid and a return port 22 for connection with a hydraulic reservoir. Preferably, the respective inlet and return ports of the servo actuators are connected to separate and independent hydraulic systems in the aircraft, so that in the event one of the hydraulic systems fails or is shut down, the servo actuator coupled to the other still functioning hydraulic system may be operated to effect the position control function. Hereinafter, the hydraulic systems associated with the servo actuators 12 and 14 will respectively be referred to as the aft and forward hydraulic systems.

In each of the servo actuators 12 and 14, a passage 24 connects the inlet port 20 to a servo valve 26. Another passage 28 connects the return port 22 to the same servo valve 26. Each passage 24 may be provided with a check valve 30.

The main control servo valve 26 includes a spool 32 which is longitudinally shiftable in a sleeve 34 which in turn is longitudinally shiftable in the system housing 36. The spool and sleeve are divided into two fluidically isolated valving sections indicated generally at 38 and 40 in FIG. 1, which valving sections are associated respectively with the actuators 12 and 14 and the passages 24 and 28 thereof. Each valving section of the spool and sleeve is provided with suitable lands, grooves and passages such that either one of the spool or sleeve may be maintained at a neutral or centered position, and the other selectively shifted for selectively connecting the passages 24 and 28 of each servo actuator to passages 42 and 44 in the same servo actuator.

The passages 42 and 44 of both servo actuators 12 and 14 are connected to the dual cylinder tandem actuator 16 which includes a pair of cylinders 46. The passages 42 and 44 of each servo actuator are connected to a corresponding one of the cylinders at opposite sides of the piston 48 therein. If desired, anti-cavitation valves 50 and 52 respectively may be provided in the passages 42 and 44. The pistons 48 and the cylinders 46 are interconnected by a connecting rod 54 and further are connected by output rod 56 to the control element 18 through linkage 58.

From the foregoing, it will be apparent that selective relative movement of the spool 32 and sleeve 34 simultaneously controls both valving sections 38 and 40 which selectively connect one side of each cylinder 46 to a high pressure hydraulic fluid source and the other side to fluid return for effecting controlled movement of the output rod 56 either to the right or left as seen in FIG. 1. In the event one of the servo actuators 12, 14 fails or is shut down, the other servo actuator will maintain control responsive to selective relative movement of the spool and sleeve.

The relatively shiftable spool 32 and sleeve 34 provide for two separate operational modes for effecting the position control function. The spool, for example, may be operatively associated with a manual operational mode while the sleeve is operatively associated with a control augmented or electrical operational mode. In the manual operational mode, spool positioning may be effected through direct mechanical linkage to a control element in the aircraft cockpit. As seen in FIG. 1, the spool may have a cylindrical socket 58 which receives a ball 60 at the end of a crank 62. The crank 62 may be connected by a suitable mechanical linkage system to the aircraft cockpit control element. For a more detailed description of such a mechanical linkage system, reference may be had to U.S. Pat. No. 3,956,971 entitled "Stabilized Hydromechanical Servo System", issued May 18, 1976.

Normally, the manual control mode will remain passive unless a failure renders the electrical mode inoperable. During operation in the electrical mode, the spool 32 is held in a neutral or centered position while the sleeve 34 is controllably shifted to effect the position control function by the hereinafter described control actuation system designated generally by reference numeral 70.

The control actuation system 70 of the invention includes an electro-mechanically controlled, hydraulically powered actuator 72 which is shown positioned generally in axial alignment with the main control servo valve 26 as seen at the lower left in FIG. 1. The actuator 72 includes a tandem piston 74 which is positioned for axial movement in a stepped cylinder bore 76 in the housing 36. At its end nearest the servo valve 26, the piston 74 has a piston extension 80 which extends axially in a cylindrical bore 82 of the housing 36, which bore may be an axial continuation of the cylindrical housing bore 84 accommodating the sleeve 34 and spool 32. The sleeve extension 80 is connected by suitable means to the sleeve 34 such as in the manner more particularly shown and described in applicant's above noted U.S.

patent application Ser. No. 442,873. The sleeve extension 80 also may have a diametral slot 86 therein which may be engaged by a spring biased plunger 88 to lock the interconnected piston 74 and sleeve 34 against axial movement. As will be further discussed hereinafter, the plunger 88 normally is maintained out of engagement with the slot 86 during operation in the electrical mode by hydraulic system pressure.

The tandem piston 74 includes two serially connected or arranged piston sections 90 and 92. The piston section 90 has a cylinder pressure surface 94 and a source pressure surface 96 in opposition to the cylinder pressure surface 94. Similarly, the piston section 92 has a cylinder pressure surface 98 and an opposed source pressure surface 100. Also, the corresponding cylinder and source pressure surfaces of the piston sections are opposed and have equal effective pressure areas, respectively. This results in balanced forces acting on piston sections having matched characteristics.

The source pressure surfaces 96 and 100 of the piston sections 90 and 92 respectively are in fluid communication with passages 102 and 104 which, as seen in FIG. 1, lead to shut-down valves 106 and 108, respectively. The shut-down valves 106 and 108 may be conventional three-way, solenoid-operated valves which when energized respectively establish communication between the passages 102 and 104 and supply passages 110 and 112 that connect the shut-down valve 106 and 108 to the forward and aft hydraulic system supplies associated with the actuators 14 and 12, respectively. When de-energized, the shut-down valves 106 and 108 respectively connect the passages 102 and 104 to return passages 114 and 116 which are connected to the forward and aft hydraulic system returns associated with the actuators 14 and 12, respectively. For a purpose that will become more apparent below, the passages 114 and 116 have therein centering rate control or metering orifices 118 and 120, respectively.

Figure 2:
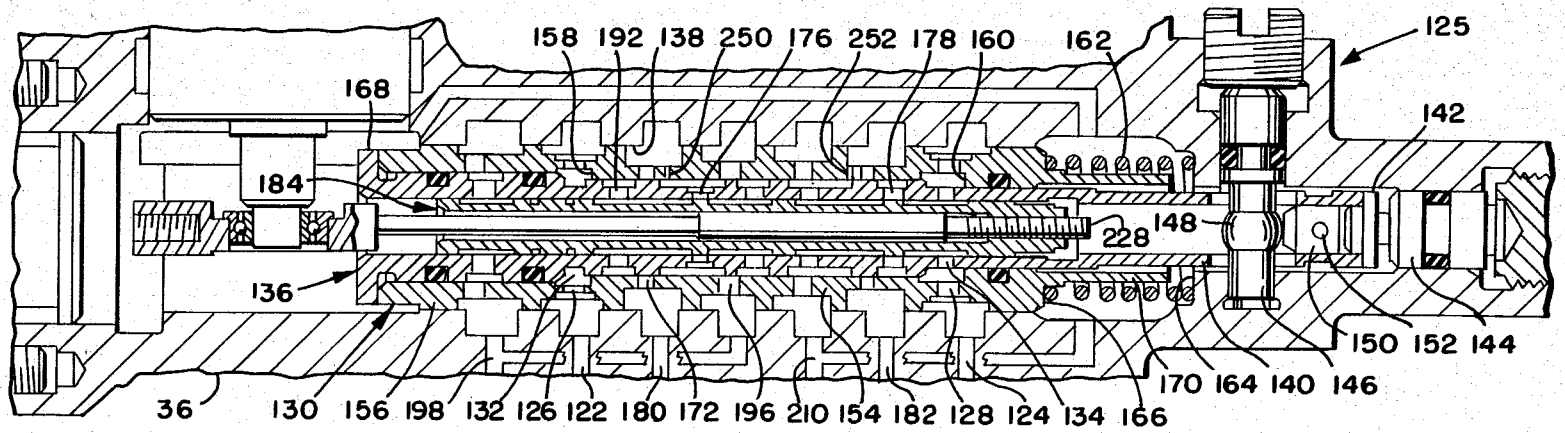
FIG. 2 is an enlarged section through such staged direct drive valve with fault control shown in its shutdown condition.
Figure 3:
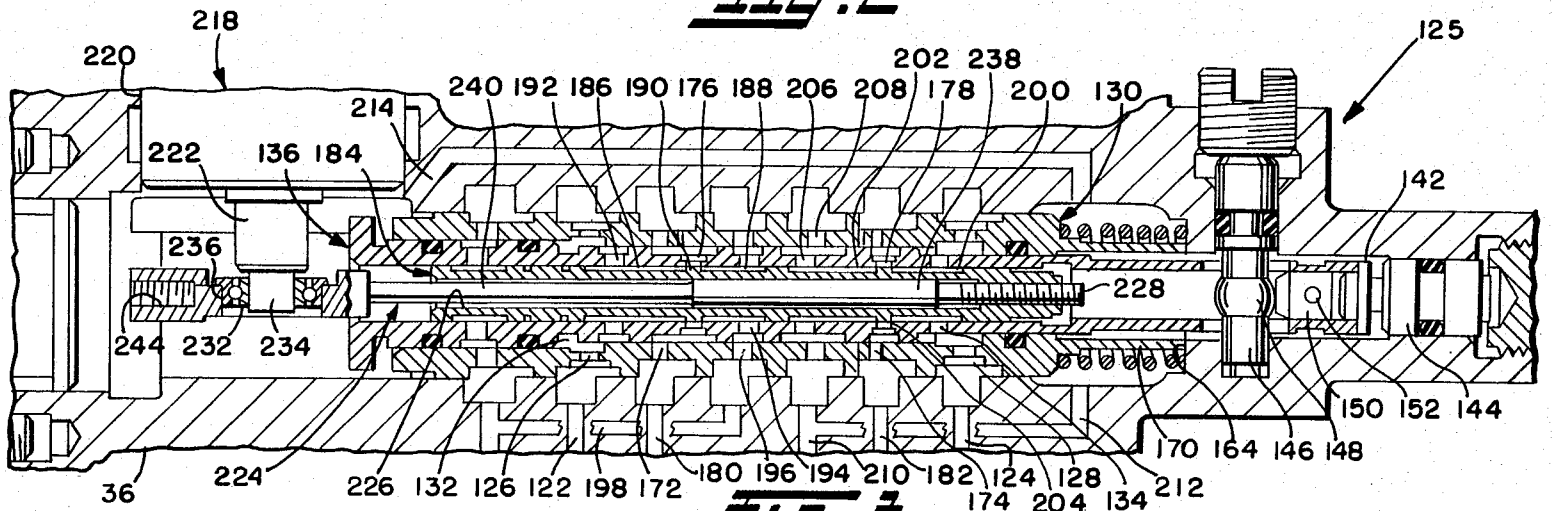
FIG. 3 is an enlarged section similar to FIG. 2 but showing the staged valve in its operational condition.

Referring additionally to FIGS. 2 and 3, the passages 102 and 104 also respectively are connected by passages 122 and 124 to a remotely located pilot or staged valve 125. More particularly, the passages 122 and 124 are respectively connected to ports 126 and 128 in a fault control valve sleeve 130, and the ports 126 and 128 in turn respectively are in fluid communication with annular groove 132 and port 134 in a static porting sleeve 136. The fault control valve sleeve 130 and static porting sleeve 136 are concentrically arranged in a bore 138 of the system housing 36 with the fault control valve sleeve being axially shiftable relative to the housing 36 and porting sleeve 136, and the porting sleeve being fixed to the housing 36 against axial movement.

As seen at the right in FIG. 2, the porting sleeve 136 has a cylindrical extension 140 which has an end piece 142 axially butted against a stop plug 144 fixed in the housing 36 to prevent axial movement of the porting sleeve 136 to the right as seen in FIG. 2. The cylindrical extension 140 also is diametrically slotted for receipt of a diametrically extending pin 146 fixed in the housing 36 which has a central ball portion 148. The ball portion 148 serves as an axial stop against which bears a plug insert 150 that is fixed in the cylindrical extension 140 by means of a pin 152. Accordingly, the indicated engagement of the plug insert 150 against the ball portion 148 of the pin 146 prevents axial movement of the porting sleeve 136 to the left as seen in FIG. 2.

The fault control valve sleeve 130 has a cylindrical outer surface of constant diameter, whereas the radially inner surface thereof, and thus the opposed radially outer surface of the porting sleeve 136, is radially stepped along its axial length to provide different thickness valve sleeve portions. As a result, the fault control valve sleeve has a slightly reduced thickness central portion 154 extending between the ports 126 and 128 and a still further reduced thickness portion 156 extending to the left of the port 126 thus providing two differential pressure surfaces 158 and 160 at the right side of each of the ports 126 and 128 as seen in FIG. 2 and exposed to the fluid pressure supplied to such ports. Thus, connection of either or both ports 126 and 128 to respective sources of high pressure fluid will shift the fault control valve to the right relative to the porting sleeve 136 and to its control enabling position seen in FIG. 3.

Such shifting of the fault control valve sleeve 130 is opposed by the force exerted by a spring 162 which is positioned at the right end of the bore 138 and bears in opposition against the end wall 164 of the bore 138 and a shoulder 166 on the valve sleeve 130. Accordingly, the spring 162 urges the fault control valve sleeve 130 to the left as seen in FIG. 2 and towards a radially outwardly extending flange 168 on the porting sleeve 136 which acts as a stop to define the control disabling position of the fault control valve sleeve when butted thereagainst. On the other hand, the end wall 164 acts as an opposed stop to define the enabling position of the fault control valve sleeve when a cylindrical extension 170 on the fault control valve sleeve is butted thereagainst as seen in FIG. 3.

When the fault control valve sleeve 130 is in its enabling position of FIG. 3, ports 172 and 174 in the fault control valve sleeve respectively effect communication between ports 176 and 178 in the porting sleeve 136 and the passages 180 and 182 which in turn respectively communicate with the cylinder pressure surfaces 94 and 98 as seen in FIG. 1. In addition, the ports 176 and 178 are associated with respective axially arranged valving sections of a valve plunger 184.

The valve plunger 184 of the staged valve 125 is concentric with and constrained for axial movement in the porting sleeve 136. The valving section of the valve plunger associated with the port 176 consists of annular grooves 186 and 188 which are axially separated by a metering land 190. The metering land 190 is operative to block communication between the associated port 176 and the grooves 186 and 188 when the plunger 184 is in a null position. However, upon axial movement of the plunger relative to the porting sleeve 136 and out of its null position, the metering land is operative to effect communication between the port 176 and one or the other of the grooves 186 and 188 depending on the direction of movement.

The groove 186 is in fluid communication with a port 192 in the porting sleeve 136 which in turn communicates with the port 126 when the fault control valve sleeve 130 is in its enabling position of FIG. 3. Accordingly, fluid pressure will be supplied to the groove 186 when the passage 122 is connected to the supply passage 110 by the shut-down valve 106. It is noted that at the same time, fluid pressure will be applied on the source pressure surface 96 of the piston section 90. The other groove 188 is in communication with a port 194 in the porting sleeve 136 which in turn communicates via a port 196 in the fault control valve sleeve 130 with a passage 198 connected to the return passage 114 downstream of the orifice 118 as seen in FIG. 1. Accordingly, the groove 118 is connected to the return of the respective or forward hydraulic system.

Similarly, the valving section of the pilot valve plunger 184 associated with the port 178 has a pair of annular grooves 200 and 202 which are axially separated by a metering land 204 which is operative in the same manner as the metering land 190 but in association with the port 178. The groove 200 is in fluid communication with the port 134 whereas the other groove 202 is in fluid communication with the return passage 116 of the respective or aft hydraulic system via a port 206 in the porting sleeve, port 208 in the fault control valve sleeve and a passage 210 connected to the return passage 116 downstream of the orifice 120 as seen in FIG. 1.

The staged valve 125 also has a passage 212 which connects the passage 210 to the right or outer end of the bore 138 as seen in FIG. 3. Accordingly, the right end face of the plunger 184 will be exposed to return pressure of the aft hydraulic system. Also provided is a passage 214 which connects the right end of the bore 138 to the left end thereof so that the left end face of the plunger 184 is exposed to the same fluid pressure as its right end face. Moreover, the left and right end faces of the plunger have equal effective pressure areas whereby return pressure variations will not apply unbalanced forces and consequent inputs to the plunger.

It should now be apparent that selective axial movement of the plunger 184 relative to the porting sleeve 136 simultaneously controls both valving sections thereof which in turn control the differential application of fluid pressure from respective independent hydraulic systems on the opposed pressure surfaces of the piston sections 90 and 92. If the plunger is moved to the right from its null position, fluid pressure is applied to the cylinder pressure surface 94 of piston section 90 from the forward hydraulic system source associated therewith while fluid pressure is released from cylinder pressure surface 98 of piston section 92 to the aft hydraulic system return associated therewith. The resultant pressure imbalance will hydraulically power the piston 74, and thus the main control servo valve sleeve 34, to the right as seen in FIG. 1. Conversely, if the plunger is moved to the left from its null position, fluid pressure is applied to the cylinder pressure surface 98 of the piston section 92 from the aft hydraulic system source associated therewith while fluid pressure is released from the cylinder pressure surface 94 of the piston section 90 to the forward hydraulic system return associated therewith. Under these conditions, the resultant pressure imbalance will hydraulically power the piston 74 and valve sleeve 34 to the left as seen in FIG. 1. Accordingly, movement of the plunger in either direction will control the differential application of fluid pressure on the piston sections 90 and 92 to effect movement of the piston in opposite directions. In addition, either piston section and associated valving section of the plunger will maintain control of the piston in the event that the hydraulic system associated with the other is shut down or otherwise lost.

With particular reference to FIG. 3, controlled selective movement of the valve plunger 184 may be effected by a force motor 218 located closely adjacent one end of the plunger. The force motor may be responsive to command signals received from the aircraft cockpit whereby the force motor serves as a control input to the plunger. Also, the force motor preferably has redundant multiple parallel coils so that if one coil or its associated electronics should fail, its counterpart channel will maintain control. Moreover, suitable failure monitoring circuitry is preferably provided to detect when and which channel has failed, and to uncouple or render passive the failed channel.

The force motor 218 includes a motor housing 220 which is secured in the system housing 36 closely adjacent one end of the valve plunger 184 with its drive shaft 222 extending perpendicularly to a plane through the longitudinal axis of the valve plunger. The drive shaft is shown drivingly connected to the valve plunger by a flexible link member or quill 224 which is connected at opposite ends to the valve plunger and drive shaft. The valve plunger being tubular as shown has an axial bore 226 through which the quill extends for connection at its threaded end 228 to the closed end of the valve plunger furthest or opposite the force motor. At its other end, the quill extends out of the bore for connection to the drive shaft 222, such other end being provided with a ball bearing 232 engaged by an eccentric pin 234 on the drive shaft. More particularly, the eccentric pin is closely fitted in the inner race of the bearing which has its outer race closely fitted in a transverse bore 236 in the quill.

The quill 224 may have a cylindrical portion 238 and a reduced diameter flexible length portion 240. The cylindrical portion extends from the threaded end 228 of the quill about half way through the plunger 184 and is closely fitted in the axial bore 226 whereby flexing of the quill is limited to the reduced diameter portion 240. It will be appreciated that the flexing portion 240 of the quill accommodates the rise and fall of the bearing 232 without applying significant side loads to the tubular valve plunger as the eccentric pin 234 is driven by the force motor 218 through a short arcuate stroke. It also is noted that the effective length of the quill may be adjusted at its threaded end 228 for adjusting the neutral or null position of the plunger relative to a null position of the force motor.

The valve plunger 184 alternatively may be driven by a linear force motor. For this, the quill 224 is provided at its force motor connection end with a threaded axial bore 244 for connection to the linear drive element of the linear force motor. With a linear force motor, the flexible quill will accommodate any misalignment between such drive member and the valve plunger without applying significant side loads to the valve plunger.

As indicated, controlled selective movement of the valve plunger 184 is effected by the force motor 218 which is responsive to command signals received, for example, from the aircraft cockpit. To provide proper feedback information to the command system controlling the force motor, a position transducer 246 may be operatively connected to the actuator piston 74 as schematically shown in FIG. 1. With this arrangement, it will be appreciated that the stroke of the plunger and force motor may be relatively short in relation to that of the actuator piston 74 which may be required to have a relatively long stroke for driving the main control valve sleeve 34. This permits reduction of plunger length, drive motor size and energy capability, and the amount of space otherwise required to accomplish the fault control function described hereinafter.

The fault control function is effected upon shifting of the fault control valve sleeve 130 to its disabling position seen in FIG. 2. Such shifting will occur whenever the fluid pressure acting upon the differential pressure surfaces 158 and 160 of the valve sleeve 130 at the ports 132 and 134 therein is insufficient to overcome the force exerted by the spring 162. This will occur upon failure of both independent hydraulic systems or upon shut-down of the electrical operational mode by the shut-down valves 106 and 108 after multiple failures have rendered such mode inoperative. Upon such failure or shut-down, the spring 162 will shift the fault control valve sleeve 130 to its disabling position whereat the inner end of the valve sleeve will be butted against the flange 168 on the portion member 136.

When the fault control valve sleeve 103 is in its disabling position, communication between the cylinder pressure surfaces 94 and 98 and the respective supply passages 122 and 124 is blocked by the fault control valve sleeve regardless of the position of the valve plunger 184. More particularly, the fault control valve sleeve in its disabling position blocks communication between the passage 122 and the port 192 which otherwise cooperate to supply fluid pressure to the groove 186 associated with the cylinder pressure surface 94. Also, the fault control valve sleeve blocks communication between the passage 182 and port 178 associated with the cylinder pressure surface 98.

In addition, the fault control valve sleeve 130 in its disabling position blocks communication between the cylinder pressure surfaces 94 and 98 and the respective return passages 198 and 210 regardless of the position of the valve plunger 184, except through respective centering rate control or metering orifices 250 and 252 provided in the fault control valve sleeve. More particularly, shifting of the valve sleeve 130 to its disabling position blocks communication between the port 176 and port 172 while establishing communication between the passage 180 and passage 198 via the metering orifice 250. At the same time, communication between the passage 182 and port 178 is blocked as indicated above while communication between the passage 182 and passage 210 is established via the metering orifice 252.

As a result, fluid pressure from the cylinder pressure surfaces 94 and 98 will be released to the return passages 198 and 210 through the metering orifices 250 and 252 in the fault control valve sleeve 130 which control the rate at which fluid is ported from the cylinder pressure surfaces as the main control servo valve sleeve 34 and thus the piston 74 is moved to a centered or neutral position by a spring centering device 254 for system operation in the manual mode. The spring centering device 254 can be seen at the right in FIG. 1 and may be conventional.

Operation

During normal operation of the control actuation system in the electrical mode, each shut-down valve 106, 108 is energized. This supplies fluid pressure from the forward and aft hydraulic systems to the source pressure surfaces 96 and 100 of the piston sections 90 and 92, respectively. In addition, fluid pressure is supplied from the aft hydraulic system to the end of a spring biased plunger 256 seen in FIG. 1. This moves the plunger 256 to the right against the biasing force to open the passage 258 to fluid pressure for moving the plunger 88 out of locking engagement with the sleeve extension 80 thereby to permit axial movement of the main control valve sleeve 34 and the piston 74.

Fluid pressure also will be supplied to the ports 132 and 134 via passages 122 and 124, respectively, whereupon the fault control valve sleeve 130 will be shifted from its disabling position of FIG. 2 to its enabling position of FIG. 3. With the fault control valve sleeve in its enabling position, controlled positioning of the piston 74 and hence the main control valve sleeve 34 may be effected by the valve plunger 184 and force motor 218 in response to electrical command signals received from the aircraft cockpit. It will be appreciated that simultaneous energization of the shutdown valves will not cause large turn-on transients because the pressure surfaces of the piston sections result in equal and opposite forces on the piston by reason of their aforedescribed pressure area and porting relationships.

Position control of the piston 74 and main control valve sleeve 34 will be maintained even though one of the channels of the electrical mode fails or is rendered inoperative. However, if both channels fail or are rendered inoperative requiring reversion to the manual operational mode, both shut-down valves 106 and 108 are de-energized. This connects the source pressure surfaces 96 and 100 of the piston sections 90 and 92 to return pressure and effects shifting of the fault control valve sleeve 130 to its disabling position shown in FIG. 2. As the main control valve sleeve 34 is urged towards its centered or netural position by the centering spring device 254, fluid will be pumped out of the actuator mechanism at a rate controlled by the then existing pressures due to the centering spring force and the centering rate control orifices 118, 120, 250 and 252. Depending on the direction of centering movement, either the centering rate control orifices 118 and 252 or the orifices 120 and 250 will act in concert to control the rate of centering. As control orifices are provided for each piston section, centering rate control is ensured even if fluid is totally lost from one of the hydraulic systems. Moreover, centering rate control is effective regardless of the position of the piston 74 or valve plunger 184.

When in the manual operational mode, the main control servo valve sleeve 34 is held in its centered or neutral position by the centering spring device 254 and also by the locking plunger 88 which will then have moved into locking engagement with the slot 86 in the sleeve extension 80. In the unlikely event that a relatively large reaction force is applied on the valve sleeve 34 which exceeds the holding capability of the centering spring device and locking plunger, fluid pressure behind the opposing pressure surfaces of the piston sections 90 and 92 would be built up. As a result, a relatively large resistive force would be caused to act upon the piston depending on the duration of the applied reaction force thereby to resist back-driving of the piston. Of course, an extended relatively large reaction force application time would, upon unseating of the locking plunger, eventually move the piston from the center upon the pumping of fluid through the centering rate control orifices.

Although the invention has been shown and described with respect to a certain preferred embodiment, it is obvious that equivalent alterations and modifications will occur to others skilled in the art upon the reading and understanding of the specification. The present invention includes all such equivalent alterations and modifications, and is limited only by the scope of the following claims.

What is claimed is:

1. A control actuation system useful in a dual hydraulic servo actuator control system for operating a relatively long stroke, control valve element therein, comprising an actuator, a tandem piston axially movable in said actuator and drivingly connectable to the control valve element, staged valve means operatively connected to said actuator for effecting axial movement of said piston in opposite directions, and control input means including force motor means for linearly driving said staged valve means through a relatively short stroke in relation to the stroke of said piston to effect position control of said piston, said piston including two serially connected piston sections each having axially opposed pressure surfaces, and said staged valve means including a valve plunger having two serially connected valving sections respectively for controlling the differential application of fluid pressure from respective sources thereof on said opposed pressure surfaces of respective said piston sections to cause axial movement of said piston in opposite directions in response to relatively short, directly driven linear movement of said valve plunger in opposite directions, a fault control valve member axially movable in said staged valve means, and means responsive to fluid pressure from either source thereof being supplied to said staged valve means for moving said fault control valve member from a disabling position blocking the differential application of fluid pressure to said piston by said valve plunger to an enabling position permitting such application and release of fluid pressure.

2. A system as set forth in claim 1, wherein said opposed pressure surfaces of each piston section are opposed to corresponding pressure surfaces of the other piston section.

3. A system as set forth in claim 2, further comprising respective means for simultaneously supplying fluid pressure from such respective sources thereof to said actuator and staged valve means and for disconnecting such supply to effect system shut-down.

4. A system as set forth in claim 3, further comprising centering means for urging said piston to a neutral position upon system shut-down, said staged valve means including metering orifices through which fluid pressure acting on said piston is released to control the rate at which said piston is moved to its neutral position by said centering means when said fault control member is in such disabling position.

5. A system as set forth in claim 2, wherein opposed corresponding pressure surfaces of said piston sections respectively have equal effective pressure areas.

6. A system as set forth in claim 1, wherein said opposed pressure surfaces of each piston section have unequal effective pressure areas, and means are provided for applying fluid pressure from such respective sources thereof normally only on the smaller area pressure surface of respective said piston sections, said valving sections of said valve plunger being operable upon movement of said plunger either to apply fluid pressure from such respective sources thereof on the larger area pressure surfaces of respective said piston sections or to release fluid pressure acting on said larger area pressure surfaces of respective said piston sections to respective returns therefor to fluid actuation of said piston in opposite directions.

7. A system as set forth in claim 6, wherein said smaller and larger area pressure surfaces of each piston section are axially opposed to and have effective pressure areas equal to corresponding pressure surfaces of the other piston section.

8. A system as set forth in claim 6, wherein said plunger has exposed opposite end faces of equal effective pressure areas, and means are provided for applying the same fluid pressure on said end faces.

9. A system as set forth in claim 8, wherein said means for applying includes means for placing said end faces in fluid communication with one of such returns.

10. A system as set forth in claim 1, wherein said valve plunger has exposed opposite end faces of equal effective pressure areas, and means are provided for applying the same fluid pressure on said end faces.

11. A control actuation system useful in a dual hydraulic servo actuator control system for operating a relatively long stroke, a control valve element therein, comprising an actuator, a tandem piston axially movable in said actuator and drivingly connectable to the control valve element, staged valve means operatively connected to said actuator for effecting axial movement of said piston in opposite directions, and control input means including force motor means for linearly driving said staged valve means through a relatively short stroke in relation to the stroke of said piston to effect position control of said piston, said piston including two serially connected piston sections each having axially opposed pressure surfaces, and said staged valve means including a valve plunger having two serially connected valving sections respectively for controlling the differential application of fluid pressure from respective sources thereof on said opposed pressure surfaces of respective said piston sections to cause axial movement of said piston in opposite directions in response to relatively short, directly driven linear movement of said valve plunger in opposite directions, said opposed pressure surfaces of each piston section being opposed to corresponding pressure surfaces of the other piston section, respective means for simultaneously supplying fluid pressure from such respective sources thereof to said actuator and staged valve means and for disconnecting such supply to effect system shut-down, centering means for urging said piston to a neutral position upon system shut-down, and means responsive to system shut-down for releasing fluid pressure acting on opposed corresponding pressure surfaces of said piston sections through respective metering orifices to control the rate at which said piston is moved to its neutral position by said centering means, said means responsive to system shut-down including a fault control valve member axially movable in said staged valve means.

12. A system as set forth in claim 11, wherein said fault control valve member and valve plunger are concentrically arranged in said staged valve means.

13. A control actuation system useful in a dual hydraulic servo actuator control system for operating a relatively long stroke, control valve element therein, comprising an actuator, a tandem piston axially movable in said actuator and drivingly connectable to the control valve element, staged valve means operatively connected to said actuator for effecting axial movement of said piston in opposite directions, and control input means including force motor means for linearly driving said staged valve means through a relatively short stroke in relation to the stroke of said piston to effect position control of said piston, said piston including two serially connected piston sections each having axially opposed pressure surfaces, and said staged valve means including a valve plunger having two serially connected valving sections respectively for controlling the differential application of fluid pressure from respective sources thereof on said opposed pressure surfaces of respective said piston sections to cause axial movement of said piston in opposite directions in response to relatively short, directly driven linear movement of said valve plunger in opposite directions, said opposed pressure surfaces of each piston section having unequal effective pressure areas, and means for applying fluid pressure from such respective sources thereof normally only on the smaller area pressure surface of respective said piston sections, said valving sections of said valve plunger being operable upon movement of said plunger either to apply fluid pressure from such respective sources thereof on the larger area pressure surfaces of respective said piston sections or to release fluid pressure acting on said larger area pressure surfaces of respective piston sections to respective returns therefor for fluid actuation of said piston in opposite directions, a fault control valve member axially movable in said staged valve means, and means responsive to the application of fluid pressure from either source thereof upon said smaller area pressure surfaces of said piston sections for moving said fault control valve member from a disabling position blocking such application and release of fluid pressure acting on said larger area pressure surfaces to an enabling position permitting such application and release of fluid pressure.

14. A system as set forth in claim 13, further comprising shut-down means operable to release fluid pressure acting on said smaller area pressure surfaces of respective said piston sections to respective returns therefor, centering means for resiliently urging said piston to a neutral position upon operation of said shut-down means, and means for urging said fault control valve member to the disabling position thereof upon such release of fluid pressure by said shut-down means.

15. A system as set forth in claim 14, wherein said fault control valve member has porting means operative in the disabling position of said fault control valve member to release fluid pressure from said larger area pressure surfaces of said piston sections to respective returns therefor through respective centering rate control orifices to control the rate at which said piston is moved to the neutral position thereof by said centering means.

16. A system as set forth in claim 15, wherein said centering rate control orifices are located in said fault control valve member.

17. A system as set forth in claim 15, wherein said fault control valve member and valve plunger are concentrically arranged in said staged valve means.

18. A system as set forth in claim 17, wherein said fault control valve member is in the form of a sleeve surrounding said valve plunger.

19. A system as set forth in claim 13, wherein said means for moving said fault control valve member includes two differential pressure areas on said fault control valve member, and means for communicating said differential pressure areas with fluid pressure applied to said smaller area pressure surfaces, respectively.

20. A control actuation system useful in a hydraulic servo actuator control system for operating a control valve element therein, comprising an actuator, a piston axially movable in said actuator and drivingly connectable to the control valve element, staged valve means operably connectable to control input means for effecting position control of said piston, said staged valve means including a linearly movable valve plunger for directing fluid pressure against said piston to cause axial movement of said piston, centering means for urging said piston to a neutral position upon such control input means being rendered inoperative, and means responsive to such control input means being rendered inoperative for releasing fluid pressure acting on opposite sides of said piston through metering orifices to control the rate at which said piston is urged to the neutral position thereof by said centering means, said means for releasing including a fault control valve member linearly movable in said staged valve means to a position providing for the release of fluid pressure from one side of said piston through a respective one of said metering orifices.

21. A system as set forth in claim 20, wherein said respective one of said metering orifices is provided in said fault control valve member.

22. A system as set forth in claim 20, wherein said fault control valve member and valve plunger are concentrically arranged in said staged valve means.

23. A system as set forth in claim 22, wherein said fault control valve member is in the form of a sleeve surrounding said valve plunger.

24. A system as set forth in claim 20, wherein said one side of said piston has a larger area pressure surface than the other side, and means are provided for normally applying such pressure fluid only on the smaller area pressure surface of said piston, said valve plunger being selectively movable either to admit fluid pressure to said larger area pressure surface or to release fluid pressure acting on said larger area pressure surface for pressure actuation of said piston in opposite directions.

25. A system as set forth in claim 24, wherein said means for releasing further includes valve means responsive to such control input means being rendered inoperative for precluding such normal application of fluid pressure on said smaller area pressure surface and for releasing fluid pressure on said smaller area pressure surface through a respective other of said metering orifices.

26. A system as set forth in claim 25, wherein said fault control valve member when in said position precludes such admission and release of fluid pressure and when in another position permits such admission and release.

27. A system as set forth in claim 26, further comprising means for resiliently urging said fault control valve member to said position, and means responsive to such normal application of fluid pressure on said smaller area pressure surface for moving said fault control valve member to said another position thereof against said means for resiliently urging.

28. A system as set forth in claim 27, wherein said means for moving includes pressure surfaces on said fault control valve member of different effective pressure areas in fluid communication with said means for normally applying.

* * * * *